US010865720B2

(12) United States Patent
Ernst et al.

(10) Patent No.: US 10,865,720 B2
(45) Date of Patent: Dec. 15, 2020

(54) METHOD AND DEVICE FOR OPERATING A DRIVE DEVICE, AND DRIVE DEVICE

(71) Applicant: AUDI AG, Ingolstadt (DE)

(72) Inventors: Sebastian Ernst, Ingolstadt (DE); Michael Kiszkiel, Wettstetten (DE); Yinyue Feng, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 0 days.

(21) Appl. No.: 16/064,111

(22) PCT Filed: Feb. 2, 2017

(86) PCT No.: PCT/EP2017/052214
§ 371 (c)(1),
(2) Date: Jun. 20, 2018

(87) PCT Pub. No.: WO2017/134142
PCT Pub. Date: Aug. 10, 2017

(65) Prior Publication Data

US 2019/0003409 A1 Jan. 3, 2019

(30) Foreign Application Priority Data

Feb. 6, 2016 (DE) ..... 10 2016 001 399

(51) Int. Cl.
*F02D 41/00* (2006.01)
*F02D 41/02* (2006.01)
*F02D 41/14* (2006.01)

(52) U.S. Cl.
CPC ..... *F02D 41/0085* (2013.01); *F02D 41/0087* (2013.01); *F02D 41/023* (2013.01);
(Continued)

(58) Field of Classification Search
CPC ..... F02D 41/0085; F02D 41/023; F02D 2041/1412; F02D 2200/0625; F02D 2200/606; F02D 2200/701; F02D 2250/21
(Continued)

(56) References Cited

U.S. PATENT DOCUMENTS 6,687,602 B2 * 2/2004 Ament ..... F02D 11/105 123/198 F
9,599,038 B2 * 3/2017 Azadeh ..... F02D 15/00
(Continued)

FOREIGN PATENT DOCUMENTS

CN 101865043 A 10/2010
CN 101922359 A 12/2010
(Continued)

OTHER PUBLICATIONS

Examination Report dated Sep. 13, 2016 of corresponding German application No. 10 2016 001 399.0; 10 pgs.
(Continued)

*Primary Examiner* — David Hamaoui
*Assistant Examiner* — John D Bailey
(74) *Attorney, Agent, or Firm* — Maier & Maier, PLLC

(57) ABSTRACT

A method for operating a drive device of a motor vehicle, having an internal combustion engine and at least one switchable mechanism. The mechanism can be switched to change an operating state influencing a fuel consumption and switching causes an increased fuel consumption. It is proposed that a torque and a rotational speed of the internal combustion engine are predicted depending on a current operating situation, that a dwell time of the mechanism in a switching state is predicted depending on the torque and the rotational speed, and that the mechanism for changing the operating state is actuated depending on the dwell time.

7 Claims, 2 Drawing Sheets

(52) U.S. Cl.
CPC .. *F02D 41/0225* (2013.01); *F02D 2041/1412* (2013.01); *F02D 2200/0625* (2013.01); *F02D 2200/606* (2013.01); *F02D 2200/701* (2013.01); *F02D 2250/21* (2013.01)

(58) Field of Classification Search
USPC ..... 701/103
See application file for complete search history.

(56) References Cited

U.S. PATENT DOCUMENTS

2002/0128116 A1 9/2002 Idogawa et al.
2002/0132699 A1* 9/2002 Bellinger ..... F16H 61/66 477/107
2003/0216847 A1* 11/2003 Bellinger ..... B60W 10/04 701/51
2003/0224905 A1* 12/2003 Higashiyama ..... B60W 10/06 477/107
2005/0154520 A1* 7/2005 Osanai ..... F02D 41/1473 701/60
2005/0245351 A1* 11/2005 Yamada ..... B60W 10/06 477/110
2005/0245352 A1 11/2005 Pfaeffle et al.
2006/0021594 A1* 2/2006 Maruyama ..... F02D 41/3005 123/299
2006/0047395 A1* 3/2006 Ikeya ..... B60W 10/06 701/51
2006/0166784 A1* 7/2006 Tabata ..... B60K 6/547 477/37
2006/0241847 A1* 10/2006 Kolmanovsky ..... F02D 13/0211 701/103
2007/0012265 A1* 1/2007 Lewis ..... F02D 13/06 123/21
2007/0049459 A1* 3/2007 Lewis ..... F02D 13/0203 477/109
2007/0213176 A1* 9/2007 Fujii ..... B60W 10/06 477/107
2008/0228374 A1* 9/2008 Ishizuka ..... F02D 41/3836 701/103
2009/0054205 A1* 2/2009 Maekawa ..... F16H 61/0437 477/109
2009/0192692 A1* 7/2009 Hartmann ..... F02D 13/06 701/102
2009/0299587 A1* 12/2009 Ueda ..... F02D 41/0215 701/54
2010/0324789 A1* 12/2010 Ogawa ..... B60W 10/06 701/54
2011/0106388 A1* 5/2011 Boeckenhoff ..... B60W 10/06 701/70
2011/0174268 A1* 7/2011 Surnilla ..... F02M 25/025 123/406.29
2012/0059560 A1* 3/2012 Balton ..... F02D 29/02 701/54
2012/0186248 A1* 7/2012 VanDyne ..... F02B 37/105 60/609
2012/0203434 A1* 8/2012 Sujan ..... F01N 9/002 701/64
2012/0316032 A1* 12/2012 Matsushita ..... F02D 29/02 477/120
2013/0045835 A1* 2/2013 Schang ..... B60W 10/06 477/78
2013/0291830 A1* 11/2013 Doering ..... B60K 6/387 123/350
2013/0297114 A1* 11/2013 Doering ..... B60W 10/06 701/22
2013/0297121 A1* 11/2013 Reed ..... F02P 5/1508 701/22
2013/0297122 A1* 11/2013 Gibson ..... B60W 10/02 701/22
2013/0297157 A1* 11/2013 Pietron ..... B60W 20/14 701/51
2013/0297187 A1* 11/2013 Doering ..... B60K 6/26 701/104
2014/0053804 A1* 2/2014 Rayl ..... F02D 41/0087 123/350
2015/0184599 A1* 7/2015 Yokota ..... F02D 41/0087 123/402
2015/0239471 A1* 8/2015 Azuma ..... B60W 30/188 701/54
2015/0266469 A1* 9/2015 Gibson ..... B60W 10/02 701/22
2015/0354469 A1* 12/2015 Azadeh ..... F02D 15/00 123/48 R

FOREIGN PATENT DOCUMENTS

CN 103381830 A 11/2013
CN 104110318 A 10/2014
CN 104136752 A 11/2014
CN 104956049 A 9/2015
DE 102005042846 A1 3/2007
DE 102007021592 A1 8/2008
DE 102005009362 B4 12/2008
DE 102007050504 A1 4/2009
DE 102010033606 A1 8/2011
DE 102011122528 A1 6/2013
DE 102013001043 B3 10/2013
EP 2123885 A1 11/2009
JP H08-21269 A 1/1996
JP 2000-104813 A 4/2000
JP 2002-089342 A 3/2002
JP 2003-314314 A 11/2003
JP 2007-231963 A 9/2007
JP 2012-026471 A 2/2012

OTHER PUBLICATIONS

International Search Report and Written Opinion of the International Search Authority dated Apr. 11, 2017 of corresponding International application No. PCT/EP2017/052214; 17 pgs.
Notification of Transmittal of Translation of the International Preliminary Report on Patentability dated Aug. 16, 2018, including the Written Opinion of the International Searching Authority, in connection with corresponding International Application No. PCT/EP2017/052214 (7 pgs.).
Chinese Office Action dated Aug. 31, 2020, in connection with corresponding CN Application No. 201780009767.2 (17 pp., including machine-generated English translation).

* cited by examiner

METHOD AND DEVICE FOR OPERATING A DRIVE DEVICE, AND DRIVE DEVICE

FIELD

The invention relates to a method for operating a drive device of a motor vehicle, having an internal combustion engine and at least one switchable mechanism, wherein the mechanism can be switched to change an operating state influencing the fuel consumption and switching causes an increased fuel consumption.

Moreover, the invention relates to a device for operating a drive device as well as the drive device itself.

BACKGROUND

Methods, devices, and drive devices of the aforementioned kind are already known from the prior art. Different technologies for fuel economy or for reducing fuel consumption of internal combustion engines are already known, and are generally implemented by actuators that can switch between discrete operating states. Thus, for example, it is known how to switch off cylinders of an internal combustion engine in partial load operation in a targeted manner in order to save on fuel. Such a method is found, for example, in the Offenlegungsschrift (Unexamined Patent Application) DE 10 2010 033 606 A1, in which a cylinder is additionally switched in depending on a gradient of a roadway. Furthermore, a method is already known from Offenlegungsschrift (Unexamined Patent Application) DE 10 2011 122 528 A1, in which an internal combustion engine is operated in a full engine mode with all cylinders and in a partial engine mode with only some of the cylinders. A method is already known from Offenlegungsschrift (Unexamined Patent Application) DE 10 2013 001 043 B3, in which a compression ratio in the internal combustion engine is determined as a function of an anticipated operating parameter. A method is also known from the Patent DE 10 2005 009 362 B4, in which an internal combustion engine is actuated depending on a switching state or an anticipated switching change of a shift transmission.

Typically, the known technologies required an energy expenditure during the switching, resulting in an additional fuel consumption or increased fuel consumption. This additional expenditure is due to the work being performed in the adjustment by an actuator, for example, in the form of an electric current.

SUMMARY OF THE DISCLOSURE

The method according to the invention having the features of claim 1 has the advantage that a switching of the mechanism now only occurs if a fuel consumption is actually reduced or there is a savings on fuel, and not that the fuel consumption reduction intended by the switching compensates for the increased fuel consumption produced by the switching. According to the invention, it is provided for this purpose that a torque and a rotational speed of the internal combustion engine are predicted depending on a current operating situation, that a dwell time of the mechanism particularly in a current switching state or in a following switching state is predicted depending on the torque and the rotational speed, and that the actuator mechanism for switching or changing the mechanism* is actuated or switched depending on the dwell time. Thus, it is provided that a predictive torque and a predictive rotational speed are determined, resulting in particular from the current operating situation. Depending on the torque and rotational speed, the dwell time of the mechanism in the operating state is determined or estimated. In this case, the mechanism may be, in particular, a switchable shift transmission with several transmission stages. In this case, the dwell time of the shift transmission in the currently established transmission stage or in the following stage is then determined or estimated. For this purpose, it is possible, for example, to compare the rotational speed and the torque to threshold values at which a switching of the mechanism or of the transmission stage seems to be meaningful depending on the torque and the rotational speed. The dwell time within which the switching state or the transmission stage of the actuating mechanism will be maintained results therefrom. In other words, the time point at which a switching occurs will be determined. Depending on this dwell time it is determined, in particular, whether it pays to alter the switching state in regard to the fuel consumption, taking into account the increased fuel consumption for the switching process. The prediction period is appropriately longer than the minimum time that is required to overcompensate for the increased fuel consumption.

According to one advantageous enhancement of the invention, it is proposed, as already mentioned above, that a shift transmission having several transmission stages is actuated as the switchable mechanism. This results in the advantages already mentioned above.

In addition or alternatively, it is preferably proposed that a valve stroke adjustment mechanism is actuated as the switchable mechanism. Valve stroke adjustment mechanisms are basically already known. They serve to vary the valve opening sides** and/or valve strokes of a valve train of the internal combustion engine, in order to alter the air charge of the cylinders with the internal combustion engine. Thus, for example, a small valve stroke may be set in order to reduce the power of the internal combustion engine and a large valve stroke may be set to increase the power. Furthermore, it is possible by means of such a valve stroke adjustment mechanism to shut off cylinders, i.e., to close the valves so that no gas exchange occurs in the respective cylinder, despite the piston stroke. The switching of the valve stroke adjustment mechanism likewise leads to an increased fuel consumption, which is taken into account by the method according to the invention.

Especially preferred, it is proposed that an ignition angle and/or a fuel supply of the internal combustion engine will be varied upon switching in such a way that a driving torque of the drive device, especially a wheel torque, remains the same or almost the same during the switching. By changing the ignition angle or the fuel supply upon switching, it is ensured that the switching goes unnoticed by the passengers of the motor vehicle comprising the drive device. This enhances the ride comfort, and an automatic switching becomes more easily acceptable to the passengers or a purchaser of such a motor vehicle.

According to one preferred enhancement of the invention, it is proposed that the mechanism is actuated depending on a dwell time-dependent fuel consumption. As already mentioned, the switching or changing of the transmission stage and/or the valve stroke is controlled as a function of the fuel consumption and especially also depending on the increased fuel consumption.

Furthermore, it is preferably proposed that a probable fuel consumption is predicted and compared to an increased fuel consumption that is necessary for the switching, in order to make a decision as to the switching. The increased fuel consumption may be determined by prior tests or calculations. The probable fuel consumption results from the operating situation and the predicted torque and the predicted rotational speed, as already described above. Thus, by the direct comparison taking into account the ascertained dwell time an easy estimate can be made as to whether or not the switching is meaningful in energy terms.

According to one preferred enhancement of the invention, it is provided that the dwell time is determined depending on an identified driver type. For this purpose, appropriately, the driver type of the current driver of the motor vehicle is characterized by a particular driving behavior, which is identified during operation or when commencing operation. Different driver types differ, for example, in that one will operate the motor vehicle with optimal consumption, another with optimal power. This results in different dwell times, for example, a consumption-conscious driver will initiate an upshift of the transmission stage sooner than a sporty driver. The driver type identification is made preferably depending on an actuation of a gas pedal and/or brake pedal, a current steering wheel angle, and/or the relationship between target speed and actual speed. Thanks to this driver type identification, the behavior of the driver in the immediate future is predictable.

According to one preferred enhancement of the invention, it is moreover proposed that the dwell time is determined depending on a traffic situation. The traffic information, especially the current traffic congestion, may indicate a significant influence on the vehicle speed and thus on the driving torque demanded of and delivered by the internal combustion engine. The current traffic situation will be [determined]*, in particular, depending on sensor data of the motor vehicle, especially that of driver safety systems having ultrasound sensors, distance sensors, or the like. Alternatively or additionally, it is preferably provided that current traffic data be obtained wirelessly and taken into consideration to determine the traffic congestion.

Furthermore, it is preferably provided that the dwell time is determined depending on data of a navigation system of the motor vehicle. In particular, the travel route of the motor vehicle is determined beforehand by means of the data of the navigation system. In particular, a distinction is made in this way between a target destination mode, in which the driver of the motor vehicle has indicated a target destination, and a free driving mode without active navigation. In the first case, the travel route is entirely known by the navigation system, so that a prediction can be made with utmost certainty as to the driving behavior of the driver, especially depending on the identified driver type. In particular, the navigation data may be used to identify hills or gradients, as well as curves and also intersections or traffic lights, which are located on the travel route, and to take them into consideration when determining the dwell time. In the second case, the free driving mode, the most probable travel route of the motor vehicle in the near future is determined preferably at least depending on the current road type and road size, and the dwell time is determined depending on this.

Furthermore, it is preferably provided that the probable fuel consumption is determined depending on a current operating state of the internal combustion engine. In particular, the current fuel consumption is determined depending on the current rotational speed of the current torque, and the probable fuel consumption in the near future is determined depending thereon.

The device according to the invention having the features characterized by a specially designed control unit, which, when used as intended, carries out the method according to the invention. The advantages already mentioned are accomplished in this way. Further features and advantages will emerge in particular from what has been described above as well as the claims.

The drive device according to the invention having the features characterized by the device according to the invention. The advantages already mentioned are accomplished in this way.

BRIEF DESCRIPTION OF THE DRAWINGS

In the following, the invention shall be explained more closely with the aid of the drawing. Shown therein are.

DETAILED DESCRIPTION

Figure 1:
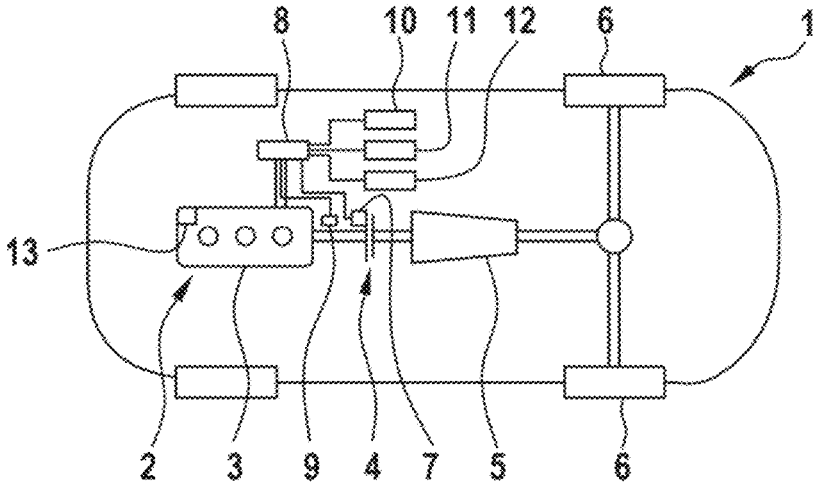
FIG. 1 a motor vehicle in a simplified top view.

FIG. 1 shows, in a simplified top view, a motor vehicle 1 having a drive device 2 that comprises an internal combustion engine 3, which is connected by an actuatable clutch 4 to an automatic shift transmission 5, which has several different transmission stages, the shift transmission 5 being operatively connected at the driven end to drive wheels 6 of the motor vehicle 1. The clutch 4 is associated with an actuator mechanism 7, which can be actuated to engage or disengage the clutch 4. For the actuating, a control unit 8 is present, which actuates the internal combustion engine 3 and the actuator mechanism 7. Furthermore, the control unit 8 is connected to a rotational speed sensor 9, which is associated with a driven shaft of the internal combustion engine 3, as well as to a navigation system 10, a traffic information system 11, and a driver type identification device 12. The internal combustion engine 3 advantageously has a variable valve train, comprising an actuatable valve stroke adjustment mechanism 13, by means of which the valve strokes and/or valve opening or closing times can be varied.

Figure 2:
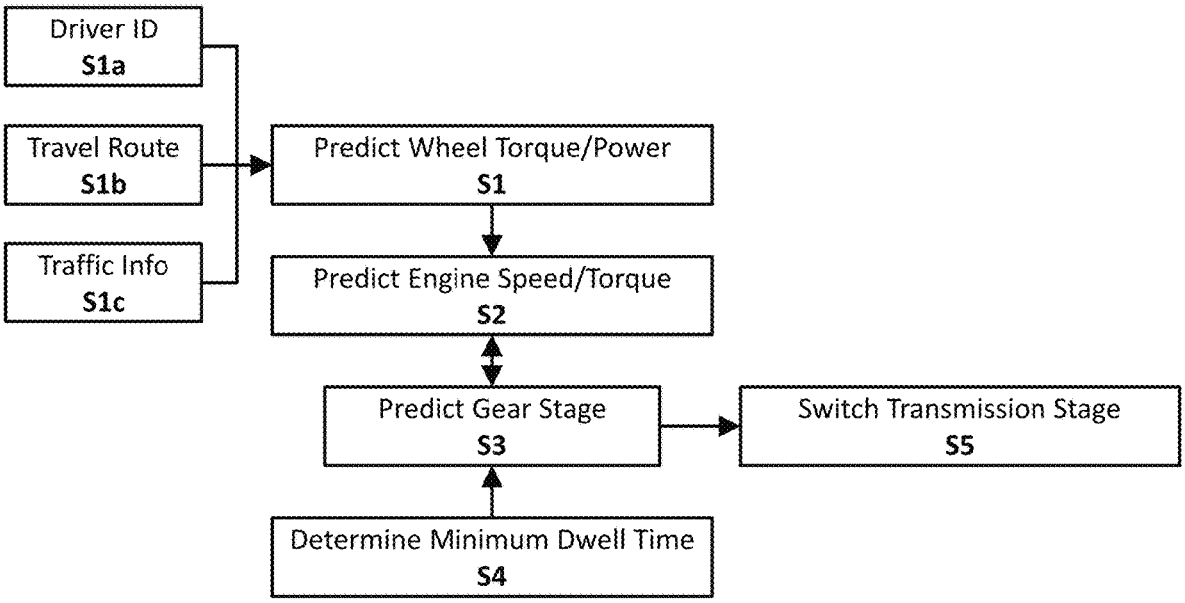
FIG. 2 a flow chart for the operation of the motor vehicle.

With the aid of FIG. 2, which shows an operating strategy for operating the motor vehicle 1 or the drive device 2 in the form of a flow chart, the operation of the drive device 2 shall now be explained, which is optimized in relation to fuel consumption of the internal combustion engine 3. Thanks to the advantageous method, a dwell time of the valve stroke adjustment mechanism 13 and/or the shift transmission 5 is predicted, each of which represents a mechanism that can be switched in order to change an operating time influencing fuel consumption and the switching causes an increased fuel consumption. In this case, a dwell time of the shift transmission 5 is to be understood to be the period of time during which an engaged transmission stage of the shift transmission 5 is maintained, or the period of time that elapses until a transmission stage of the shift transmission 5 is changed. The shift transmission is an automatic shift transmission, which is actuated by the control unit 8 in order to engage a desired transmission stage. A dwell time of the valve stroke adjustment mechanism 13 is understood to be, accordingly, the period of time during which an engaged valve stroke and established valve opening and closing times are constant or maintained. Both the switching of the shift transmission 5 and the switching of the valve stroke adjustment mechanism 13 result in an increased fuel consumption, as already mentioned above.

The operating strategy is designed to perform the changing of a transmission stage 5 or a valve stroke in a way that is optimized for fuel consumption. The most important parameters for determining the target state of the shift transmission 5 are the torque and the rotational speed of the internal combustion engine 3. In order to calculate the dwell time of the shift transmission in a state of such a drive device 2, these two parameters are predicted as quasi-continuous functions of time for the immediate future. Together with the switching thresholds of the shift transmission 5, it is thus possible to calculate the dwell time through the rotational speed and the load.

Figure 3:
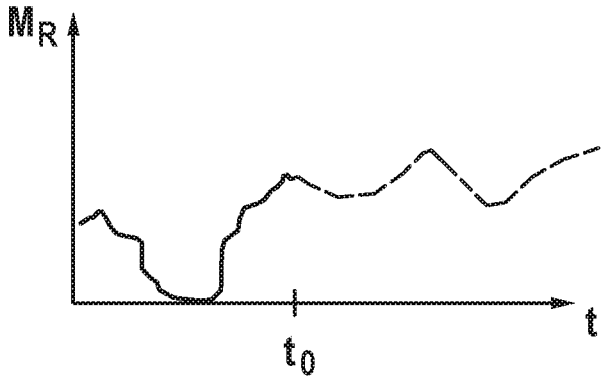
FIG. 3 a diagram for predicting wheel power.

For this purpose, it is provided that first a wheel drive torque of the driving wheels 6 is predicted in a step S1. FIG. 3 shows, for this purpose, a drive wheel torque MR or, alternatively, a wheel power of the motor vehicle 1 or the drive device 2, plotted in a diagram as a function of the time t. The wheel power is known up to the time to and is based on measured values lying in the past. As of the time to, i.e., lying in the future, the drive wheel torque is unknown and therefore shown by broken line in FIG. 3. In order to predict the course of the wheel torque, the data of the navigation system 10, the traffic information system 11, and the driver type identification device 12 is utilized.

For this, in a step S1*a*, first a driver type identification is made by means of the driver type identification mechanism 12. The driver type identification device 12 derives the most probable behavior of the driver in the future up to the time of the prediction (to) from the behavior of the current driver of the motor vehicle 1. In particular, in this case, a distinction is made between a sporty driver, an economy-conscious driver, and an average driver. The driver type identification is an independent subroutine that is carried out on the basis of information of a gas pedal position, a brake pedal position, a steering wheel angle, a ratio of target speed to actual speed, or the like, in order to characterize the current driver of the motor vehicle 1, so that an optimized prediction of the behavior of the driver in the future is possible. It is also conceivable to determine the driver type on the basis of driver identification features. As driver identification features, for example, it is possible to identify the face of the driver by means of an optical face recognition, or identify the driver by the ignition key used by him.

In a step S1*b*, furthermore, data regarding the current travel route of the motor vehicle 1 is ascertained with the aid of the navigation system 10. With the aid of the navigation data, the travel route of the motor vehicle can be predicted with relatively good certainty for the immediate future. In particular, a distinction is made between a target destination mode and a free driving mode. In the target destination mode, the driver indicates a travel destination, so that the navigation system can calculate a travel route to reach this travel destination. In this state, it may be assumed that the driver will follow the pre-calculated travel route, so that the predicted travel route corresponds to the actual travel route with very high probability. In the free driving mode, the driver steers the motor vehicle 1 without active navigation, i.e., without indicating a travel destination. Depending on the current road type and a current road size, however, the data of the navigation system provides an indication as to the most likely travel route, which is then used in the present case as the basis for the further calculation. Given a knowledge of the travel route, it is possible, in particular, to identify hills, slopes, stops or speed-restricted zones and to take these into account when predicting the drive wheel torque.

In a step S1*c*, moreover, the data of the traffic information system 11 is evaluated by the control unit 8 in order to ascertain the current traffic congestion and/or predict the traffic congestion on the travel route, since often the vehicle speed and thus the drive wheel torque is not determined by the travel route alone, but also by the traffic congestion or the current traffic situation. The traffic congestion identification is an independent subroutine in the present case, making a pronouncement as to the current traffic congestion on the basis of target speed versus actual speed, the speed profile, and vehicle sensors such as distance sensors, ultrasound sensors, crash sensors and pre-crash sensors. Furthermore, data from a traffic information service is also preferably used, which transmits current traffic data, for example, by radio or wirelessly. Thus, for example, the traffic data of a radio transmitter, which is also being considered at the present time by the navigation system, is used to determine the traffic congestion and especially to predict the traffic congestion.

From the data thus collected, in step S1, the wheel torque or the wheel power of the drive device 2 is predicted for the immediate future, as already mentioned above.

From the predicted drive wheel torque, in a following step S2, a rotational speed and a torque of the internal combustion engine 3 is predicted for the immediate future. The predicted rotational speed and the predicted torque result from the drive wheel torque and may be calculated by a computation as the rotational speed or the torque that is necessary or advantageous for achieving the predicted drive wheel torque.

Furthermore, a gear stage prediction is also performed in a step S3 to determine or predict the rotational speed and torque.

Figure 4:
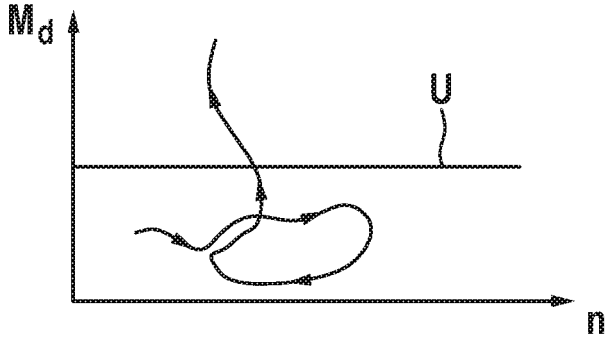
FIG. 4 a diagram of torque vs. rotational speed.

FIG. 4 shows the predicted torque Ma plotted in a diagram against the predicted rotational speed n, resulting particularly from the predicted travel route and/or the predicted traffic congestion and the identified driver type. The torque/rotational speed curve can be understood as a trajectory in the plane subtended by rotational speed and torque (characteristic rotational speed/load curve). The trajectory is parameterized by the time t. For the gear stage prediction, in step S3 one or more switching thresholds U are plotted in the diagram of FIG. 4. A switching is the intersection of the switching threshold U with the characteristic torque/rotational speed curve. The switching thresholds are determined in advance in this case in known manner and stored in the characteristic field. Then, from the value of the parameter time t of the trajectory, one obtains the time point of the switching, i.e., the time point at which the transmission stage of the shift transmission 5 will be changed. In this way, the dwell time of the shift transmission 5 in the currently engaged transmission stage is known or predicted in step S3, since the period of time until the intersection or until the switching corresponds to the sought-after dwell time.

Figure 5:
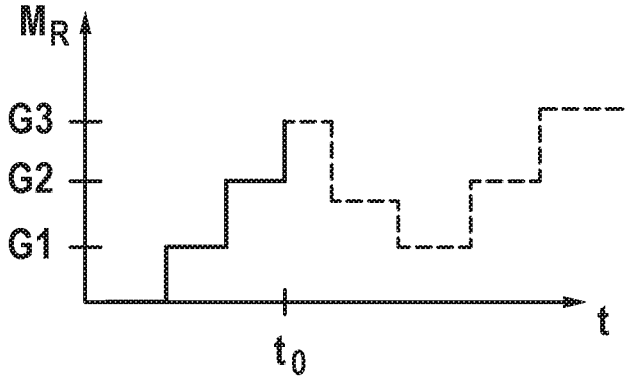
FIG. 5 a switching diagram.

The gear stage prediction as shown in FIG. 5 can be derived from the known data. FIG. 5 shows different transmission stages G1, G2 and G3 of the shift transmission G5, which were plotted, for example, against the time t. As also in FIG. 3, the switchings between the transmission stages in the past are known and therefore the characteristic curve is depicted as a solid line. Starting from the current time to, however, the switching is predicted and the characteristic curve in its further course is therefore drawn as a broken line. As can be seen in FIG. 5, one may therefore also predict several gear changes or changes in the transmission stage in the near future. The ascertained dwell time is preferably compared to a minimum dwell time. In this case, the minimum dwell time is determined in step S4 depending on a current fuel consumption and the probable fuel consumption or the fuel consumption that is predetermined on the basis of the predicted data and the increased fuel consumption needed for the switching of the transmission stage. The minimum dwell time is thereby determined such that, upon reaching the minimum dwell time, a consequent switching of the transmission stage of the shift transmission 5 does not result in an increased fuel consumption, or, if the dwell time in a state of the drive device 2 is so long that the increased fuel consumption for the switching of the transmission stage is more than compensated for by the savings between two switchings. Thus, if the ascertained dwell time is longer than the minimum dwell time, the transmission stage is then switched in a step S5; otherwise the shift transmission 5 remains in the engaged transmission stage.

As described with regard to the shift transmission 5, alternatively or additionally, the valve stroke adjustment mechanism 13 and the dwell time thereof is also taken into account. In this case, each time the switching is carried out so that it is torque-neutral. Thus, if the shift transmission 5 or the valve stroke adjustment mechanism 13 is switched, measures are taken to ensure that the drive torque of the drive device 2 remains unchanged or the same as long the driver's intent is unchanged. For this purpose, the fuel supply and/or an ignition angle of the internal combustion engine will be changed, for example. In particular, this produces an increased fuel consumption, which is taken into account when determining the dwell time or a time point for the switching, as described above.

Thus, with the described method, one ensures that a switching of the shift transmission 5 or the valve stroke adjustment mechanism 13 only occurs if there is a valid expectation that the dwell time in the state after the switching is long enough in order to economize on fuel. Thanks to this advantageous method, furthermore, it is found that switching events occur less often for the driver or other passengers of the motor vehicle 1 and the ride comfort is enhanced in this way.

The described method may be implemented likewise also in other mechanisms whose switching state influences the fuel consumption of the drive device. Such other mechanism may be, for example, a mechanism for the ignition angle adjustment or an actuator for influencing a flow pathway or a flow geometry.

The invention claimed is:

1. A method for operating a drive device of a motor vehicle, having an internal combustion engine and at least one switchable mechanism, the at least one switchable mechanism comprising at least one of a shift transmission having several transmission stages and a valve stroke adjustment device of a variable valve train of the internal combustion engine, wherein the mechanism can be switched to change an operating state influencing a fuel consumption, and a process of switching the at least one switchable mechanism causes an increased fuel consumption, wherein a torque and a rotational speed of the internal combustion engine are predicted depending on a current operating situation, and a predicted dwell time of the mechanism in a switching state is determined depending on the torque and the rotational speed, wherein the current operating situation includes:

a driver type identification based on a gas pedal position, a brake pedal position, and a steering wheel angle;

a current travel route based on a navigation system determining one or more of hills, slopes, stops or speed-reducing restricted zones; and traffic information along the current travel route from a traffic control system, wherein a minimum dwell time is determined based on a probable fuel consumption which is predicted based on the current operating situation, and compared to the increased fuel consumption caused by the process of switching the at least one switchable mechanism, and if the predicted dwell time is longer than the minimum dwell time, the mechanism for changing the operating state is actuated.

2. The method as claimed in claim 1, wherein an ignition angle and/or a fuel supply of the internal combustion engine is/are varied upon switching in such a way that a driving torque of the drive device remains the same or almost the same during the switching.

3. The method as claimed in claim 1, wherein the mechanism is actuated depending on a dwell time-dependent fuel consumption.

4. The method as claimed in claim 1, wherein the probable fuel consumption is determined depending on an operating range of the internal combustion engine.

5. The method as claimed in claim 1, wherein the probable fuel consumption is determined depending on the determined rotational speed and the determined torque.

6. A device for operating a drive device of a motor vehicle, comprising:

an internal combustion engine and at least one switchable mechanism, wherein the mechanism can be switched to change an operating state influencing a fuel consumption and a process of switching the at least one switchable mechanism causes an increased fuel consumption, wherein a specially designed control unit, which, when used as intended, carries out the method as claimed in claim 1.

7. A drive device for a motor vehicle, comprising:

an internal combustion engine having at least one switchable mechanism and a device as claimed in claim 6, wherein the at least one switchable mechanism can be switched to change an operating state influencing a fuel consumption and a process of switching the at least one switchable mechanism causes an increased fuel consumption.

* * * * *